United States Patent [19]

Floyd

[11] Patent Number: 4,537,634

[45] Date of Patent: Aug. 27, 1985

[54] COMPOUNDS AND THEIR USE AS INSOLUBILIZERS FOR BINDERS FOR PAPER COATING COMPOSITIONS

[75] Inventor: William C. Floyd, Chester, S.C.

[73] Assignee: Sun Chemical Corporation, New York, N.Y.

[21] Appl. No.: 667,716

[22] Filed: Nov. 2, 1984

Related U.S. Application Data

[62] Division of Ser. No. 500,283, Jun. 1, 1983.

[51] Int. Cl.[3] ..... C08B 31/00; C08L 3/00

[52] U.S. Cl. ..... 106/214; 428/533

[58] Field of Search ..... 106/213, 14, 214; 428/533

[56] References Cited

U.S. PATENT DOCUMENTS 4,088,630 5/1978 Roos et al. ..... 524/354

4,343,655 8/1982 Dodd et al. ..... 106/213

*Primary Examiner*—Theodore Morris

*Attorney, Agent, or Firm*—Cynthia Berlow

[57] ABSTRACT

Paper coating compositions contain at least one pigment, at least one binder, and, as an insolubilizer for the binder, the product of the reaction of glyoxal and a vicinal polyol.

4 Claims, No Drawings

COMPOUNDS AND THEIR USE AS INSOLUBILIZERS FOR BINDERS FOR PAPER COATING COMPOSITIONS

This application is a division of application Ser. No. 500,283 filed 6-1-83.

This invention relates to paper coating compositions. More particularly it relates to novel products for insolubilizing the binders in coatings for paper.

BACKGROUND OF THE INVENTION

Paper coating compositions are generally a fluid suspension of pigment, such as clay with or without titanium dioxide, calcium carbonate, or the like, in an aqueous medium which includes a binder such as starch, modified starch, styrene-butadiene copolymer, acrylic polymer, or protein to adhere the pigment to paper.

The hydrophilic nature of the binder requires the presence of an insolubilizing material which crosslinks the binder, making it hydrophobic and thus improving the characteristics of the surface of the coated paper.

The most widely-used crosslinking materials are glyoxal and formaldehyde-donor agents such as melamine-formaldehyde, urea-melamine-formaldehyde, and partially or wholly methylated derivatives thereof.

Glyoxal is a highly reactive monomer which cures quickly and has excellent insolubilizing properties. As a result of this rapid crosslinking of glyoxal and binder, however, the viscosity of the coating composition increases so rapidly and is so great that the composition cannot be used. Frequently glyoxal-insolubilized coatings gel completely, particularly in high solids formulations; gelling can occur also in moderate or low solids formulations if they are not used promptly. Thus in situations where it is required that the viscosity remain stable for many hours, for example when high-solids coatings are to be applied by blade coating techniques, a glyoxal system is unsuitable.

Melamine-formaldehyde resins do not build viscosity in the coating compositions, but they have the disadvantage of having an unpleasant odor and of releasing free formaldehyde. Curing with such resins involves the crosslinking of the binder molecule with the methylol or methylated methylol group of the melamine resin, usually in an acid or neutral coating, and full insolubilization of the binder takes place slowly over a period of several days. Free formaldehyde can be released either directly from the coating mixture or when the coating is cured on the drying machine. The presence of even less than one percent of free formaldehyde, based on the total weight of the product, is undesirable, not only because of its objectionable odor, but because it is an allergen and an irritant, causing severe reactions in the operators who manufacture the coatings and who treat and handle the coated paper.

The use of the reaction product of urea and glyoxal as an insolubilizer is known (U.S. Pat. No. 3,869,296). Treating agents formed by the reation of ethylene urea with glyoxal are disclosed in Japanese publication 5 3044-567, but they too do not have satisfactory properties. U.S. Pat. No. 4,343,655 teaches the use of the alkylated products of the reaction of glyoxal and cyclic ureas as crosslinking resins for binders for paper coating compositions.

SUMMARY OF THE INVENTION

It has now been found that the products of the reaction of glyoxal with a polyol are excellent crosslinking resins for binders for paper coating compositions. They do not build viscosity as does glyoxal; they do not contain or evolve free formaldehyde; and, in smaller amounts, they have insolubilizing effects similar to those of the previously known agents.

DETAILED DESCRIPTION OF THE INVENTION

In accordance with the present invention, novel compounds are prepared that are useful for insolubilizing starch and other commonly used binders for paper coating compositions. The products are substituted cyclic bis-hemiacetals that are prepared by reacting glyoxal with a polyol. In general, aqueous glyoxal is reacted with an equimolar amount or a slight excess of the polyol by heating and then vacuum-stripping to at least 60 percent solids.

Although the glyoxal will react with any of a wide variety of vicinal polyols, preferably the polyol is one that is on the Generally Recognized as Safe (GRAS) list or listed in CFR 176.180. These include dextrans, glycerin, glyceryl monostearate, propylene glycol, ascorbic acid, erythrobic acid, sorbic acid, ascorbyl palmitate, calcium ascorbate, calcium sorbate, potassium sorbate, sodium ascorbate, sodium sorbate, monoglycerides of edible fats or oils or edible fat-forming acids, inositol, sodium tartrate, sodium potassium tartrate, glycerol monocaprate, sorbose monoglyceride citrate, polyvinyl alcohol, and their mixtures. Other suitable polyols include, but are not limited to, α-D-methylglucoside, sorbitol, and dextrose, and mixtures thereof.

The glyoxal solution is acidic (pH of about 2–3) and provides sufficient catalytic action that no other catalyst is required. This does not preclude addition of an acid catalyst to effect reaction, if desired. The aqueous portion of the glyoxal and any excess polyol that is present act as the solvent. If desired to aid in the azeotropic removal of water, other solvents such as butanol may be used, but this is not necessary.

The reaction of the glyoxal and the polyol generally takes place at a temperature between room temperature and reflux, and preferably at about 70° to 90° C. The reaction time is generally about 1 hour to 8 hours, and preferably it is about 4 hours.

Vacuum may be applied to remove water until the desired solids content is attained. In general about 15 to 24" Hg of vacuum is applied at a temperature necessary to distill water.

The pH of the reaction mixture must be less than 8, and preferably it is between about 3 and 6. If it is necessary to raise the pH, a reagent such as sodium bicarbonate can be used.

The amounts of the glyoxal and the polyol that are reacted are based on equivalence; for example, for a mole of polyol having 3 adjacent hydroxyl groups, 1 mole of glyoxal is required to form the cyclic bis-hemiacetal and the third polyol hydroxyl group lends stability to hydrolysis to the molecule via intramolecular hydrogen bonding. The cyclic bis-hemiacetal will form to the greatest extent possible, depending on the limiting reagent that is, the one present in the lesser amount on an equivalent basis, i.e., glyoxal.

A hexahydroxy compound such as sorbitol ideally reacts with 2 moles of glyoxal to form isomeric bis-(hydroxy methyl methylene cyclic bis-hemiacetals); however, 1 mole of glyoxal can react with 1 mole of sorbitol or other hexahydroxy hexane to form a mixture of isomeric tetrahydroxyalkyl cyclic bis-hemiacetals. This mixture of compounds performs as a starch insolubilizer by releasing 1 mole of glyoxal upon cure and is stabilized by internal hydrogen bonding, but it is less efficient than a bicyclic sorbitol that releases 2 moles of glyoxal. Thus, while a slight deficiency of glycerin will yield a functional product, free glyoxal will remain which may cause coating viscosity problems. An excess of glycerin (about 10 to 50 percent, but preferably 20 percent) drives the reaction to completion and yields a product with no free glyoxal. For a hexol, 0.3 to 1 mole of hexol ±10 percent per mole of glyoxal will produce varying mixtures of cyclic bis-hemiacetal derivatives, but 0.5 mole of hexol per mole of glyoxal is preferred.

The following are typical of the products of this invention:

| Product | | Starting polyol |
|---|---|---|
| 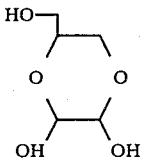 | | glycerin |
| 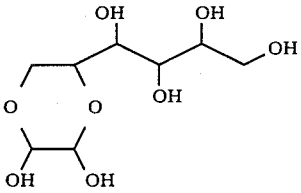 | + isomers | sorbitol |
| 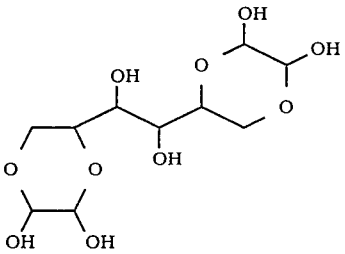 | + isomers | sorbitol |
| 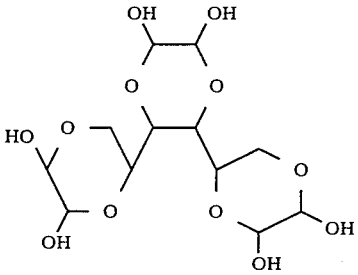 | | sorbitol |
| 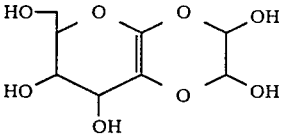 | + isomers | dextrose |

-continued

| Product | | Starting polyol |
|---|---|---|
| 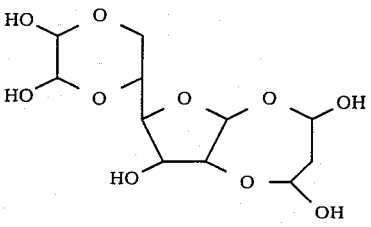 | + isomers | dextrose |
| 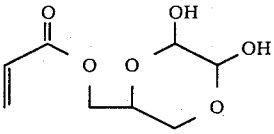 | | glycerin mono-acrylate |
| 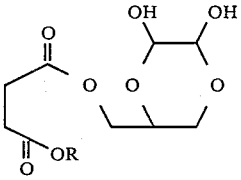 | | glycerin mono-maleic acid ester |

where R is H, Na, K, an alkyl group having up to 6 carbon atoms, or an alkoxyalkyl group having up to 6 carbon atoms It is believed that the novel compounds of this invention function by breaking down, during cure conditions and not before, into the polyol and glyoxal, the glyoxal then reacting with the binder. Thus, for example, when isopentose is decomposed in the presence of starch, the breakdown products are glyoxal and glycerin. The glyoxal then reacts with the starch.

Because of their monomeric nature, these new compounds can be dispersed more easily and more uniformly, giving better printing properties on the paper.

Since there is no formaldehyde in the system, the problems found with free formaldehyde are avoided.

The binders used in the paper coating compositions of this invention include, but are not limited to, unmodified starch; oxidized starch; enzyme-converted starch; starches having functional groups such as hydroxyl, carbonyl, amido, and amino groups; proteins, such as casein; latexes, such as styrene-butadiene resin; and the like, and their mixtures.

The pigments may be clay with or without titanium dioxide and/or calcium carbonate, and the like, and mixtures thereof.

In addition to the binder, the pigment material, and the insolubilizer described above, paper compositions may also include conventional materials such as lubricants, defoamers, preservatives, colored pigments, and the like, in conventional amounts.

In the paper coating compositions described herein, the amount of binder is based upon the amount of pigment; the ratio varies with the amount of bonding desired and with the adhesive characteristics of the particular binder employed. In general the amount of binder is about 4 to 25 percent, and preferably about 10 to 20 percent, based on the weight of the pigment.

The amount of insolubilizer varies with the amount and properties of the binder and the amount of insolubilization desired; in general it is about 1 to 12 percent, and preferably about 4 to 8 percent, based on the weight of the binder.

The total solids content of the composition generally is within the range of about 50 to 70 percent, depending upon the method of application and the product requirements.

The compositions of this invention can be applied to paper or paper-like substrates by any known and convenient means.

Although this invention will be described in relation to insolubilizers for binders for paper coating compositions, it is not intended to be limited thereto. The products of this invention can be used in other applications where glyoxal is commonly used, such as for example in treating textiles, strength resins, acrylic polymers, and the like.

In order that the present invention may be more fully understood, the following examples are given by way of illustration. No specific details contained therein should be construed as limitations on the present invention except insofar as they appear in the appended claims. Unless otherwise specified, all parts and percentages are by weight.

EXAMPLE 1

Preparation of Isopentose

To a 1-liter 3-necked flask equipped with a mechanical stirrer, reflux condenser, and thermometer were charged 200 g. (2.17 moles) of glycerin and 290 g. (2.00 moles of 40% glyoxal). This was heated to 80°–90° C. and held for 4 hours. The clear, pale yellow solution was then cooled and stored. Nonvolatile solids were approximately 63–65%. Viscosity (RV, #4 spindle, 100 rpm) was about 25 cps.

The solids content was increased to 80–85 percent by vacuum stripping water from the product. The observed spectra were consistent with the proposed structure.

EXAMPLE 2

Preparation of Maleic acid mono(2,3-dihydroxy-1,4-dioxane-5-methylene)ester

To a 1-liter 3 necked flask equipped with a mechanical stirrer, reflux condenser, and thermometer were charged 97 g. (1.05 moles) of glycerin. As this was stirred, 98 g. (1.00 mole) of maleic anhydride was slowly added. As this dissolved, it exothermed to 45°–50° C. The reaction was maintained at 50° C. for 2 hours or until anhydride peaks were no longer present in the infrared spectrum. The flask contained maleic acid monoglyceride. To this was added 145 g. (1.00 mole) of 40% glyoxal. The reaction was heated to 70°–80° C. and held for 3 hours. The product was then cooled to 40° C. and discharged as a syrup. The observed spectra were consistent with proposed structure.

EXAMPLE 3

To prepare an alkali metal salt of the product of Example 2, the procedure of that Example was repeated until the anhydride peaks in the infrared spectrum disappeared. The product was then cooled to 40° C. and the pH adjusted to 6.5–6.8 with a dilute (25%) solution of sodium hydroxide. Glyoxal was then added, and the process was continued as in Example 2.

EXAMPLE 4

The procedure of Example 3 was repeated except that potassium hydroxide was used instead of sodium hydroxide. The results were comparable.

EXAMPLE 5

Preparation of a mixture of 1,2,5,6-di(dihydroxydioxano)-3,4-dihydroxyhexane and 1,2,4,5-di(dihydroxydioxano)-3,6-dihydroxyhexane (Major isomers)

To a 1-liter 3 necked flask fitted with a mechanical stirrer, condenser, and thermometer was added 260 g. (1 mole) of an aqueous 70% solution of sorbitol. To this was then added 290 g. (2 moles) of 40% aqueous glyoxal. The reaction was heated to 70°–80° C. and held for 4 hours. At this point, nonvolatile solids were 52–55 percent. Water was distilled off under vacuum, increasing the solids content to 45 percent. The observed spectra were consistent with proposed structure.

EXAMPLE 6

The procedure of Example 1 was repeated with each of the following polyols instead of glycerine: 1,2,3,4-tetrahydroxybutane and $\alpha$-methylglucoside.

The results were comparable.

EXAMPLE 7

To illustrate the superiority of the substituted compounds of this invention over unsubstituted material, samples of 2,3-dihydroxy-5-methyl-1,4-dioxane were used to prepare aqueous solutions of 50% and 80% solids. Within 2 weeks, at room temperature, both showed crystallization tendencies and the higher solids sample had solidified. Similar solutions of 2,3-dihydroxy-5-hydroxymethyl-2,4-dioxane were prepared, and after a month at room temperature they showed no crystals and were pourable solutions.

EXAMPLE 8

(A) A clay slip was prepared as follows:

To 600 parts of water in a 2-liter steel beaker were added 2.5 parts of tetrasodium polyphosphate and 2.0 parts of sodium polyacrylate with agitation which was continued until the ingredients were dissolved. With slow agitation and using a high shear mixer, 1400 parts of #1 clay was sifted into the mixture and agitation was increased and continued for about 10 minutes until a smooth slurry was obtained.

(B) 168 Parts of starch (Penford Gum 280, Penick & Ford's hydroxyethylated starch) was dispersed in 504 parts of water, and the dispersion was heated to boiling. The solution was then cooled for about 15 minutes, added to the clay slurry of Part (A), and calcium stearate added as a lubricant.

The resultant slurry was then used in aliquots with various insolubilizers.

The coating compositions were applied to 46#/ream paper with a #8 Meyer applicator, using a draw-down technique, cured at 105° C., and aged for 1 day.

An Adams Wet Rub test was carried out on each sample. The results of the Wet Rub test are reported as the weight in grams of coating removed from the substrate, the less the amount of solids removed, the better the degree of insolubilization.

The results are tabulated below.

TABLE

| Insolubilizer | Amount | Adams Wet Rub Residue (g) |
|---|---|---|
| (a) Blank | — | 0.0034 |
| (b) Melamine-formaldehyde | 8% | 0.0035 |
| (c) Cyclic urea-glyoxal condensate | 4% | 0.0015 |
| (d) 2,3-dihydroxy-5-hydroxymethyl-1,4-dioxane | 2% | 0.0013 |
| (e) Sorbitol/glyoxal condensate (1:2) | 2% | 0.0015 |
| (f) Sorbitol/glyoxal condensate (1:3) | 2% | 0.0011 |

From these data it can be seen that the products of this invention, (d), (e), and (f), are much more effective insolubilizers than melamine-formaldehyde (b) at one-fourth the amount and slightly more effective insolubilizers than the cyclic urea-glyoxal condensate (c) at half the amount.

EXAMPLE 9

To illustrate the superiority as an insolubilizer for a binder of a paper coating composition of a product of this invention over glyoxal, a coating composition was prepared as in Example 8(A). 2,3-Dihydroxy-5-hydroxymethyl-1,4-dioxane at the 2% (dry/dry) level against glyoxal at the 1% level were added to samples of the coating compositions, and their viscosities, as measured with a Brookfield Viscosimeter, were plotted against time and the results of the Adams Wet Rub test. Wet rub values were equivalent, but the glyoxal coating at room temperature was from 1,000 to 500 cps. higher in viscosity over a 2-hour period.

From these data can be seen that the product of this invention is a better insolubilizer than is glyoxal since the viscosity of the former is significantly lower than that of the latter, while the results of the Adams Wet Rub test are comparable.

EXAMPLE 10

Starch-based paper coatings were prepared, one containing 2 percent based on the weight of the starch in the sample, of 2,3-dihydroxy-5-methyl-1,4-dioxane (g) and the second containing an equimolar amount of 2,3-dihydroxy-5-hydroxymethyl-1,4-dioxane (d). Coating viscosity was plotted against time for 2.5 hours. After 0.5 hour, the viscosity of the coating with (g) was 350 cps. higher than the one with (d). After 1.5 hours, the viscosity of the coating with (g) was 750 cps. higher than the one with (d).

These results show that the substituted product of this invention (d) is more stable in coatings than is the unsubstituted compound (g).

The novel products of this invention do not contain or evolve free formaldehyde, as do the conventional melamine-formaldehyde and urea-melamine-formaldehyde crosslinking agents. Smaller amounts of the compounds of this invention produce insolubilizing effects comparable to those of the conventional materials. They satisfactorily insolubilize the pigment binders, but do not build viscosity as does glyoxal.

What is claimed is:

1. A paper coating composition comprising a pigment, a binder, and as an insolubilizer for the binder the hemiacetal product of the reaction of glyoxal and a polyol selected from the group consisting of glycerin, sorbitol, dextrine, α-methylglucoside, and their mixtures.

2. A process for insolubilizing the binder in a paper coating composition which comprises including in the composition about 1 to 3 percent of the hemiacetal product of the reaction of glyoxal and a polyol selected from the group consisting of glycerin, sorbitol, dextrine, α-methylglucoside, and their mixtures.

3. The composition of claim 1 wherein the binder is a starch.

4. A cellulose substrate coated with the composition of claim 1.

* * * * *